US006769881B2

(12) United States Patent
Lee

(10) Patent No.: US 6,769,881 B2
(45) Date of Patent: Aug. 3, 2004

(54) VACUUM PREVENTING DEVICE FOR SCROLL COMPRESSOR

(75) Inventor: Dong-Soo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 10 days.

(21) Appl. No.: 10/338,750

(22) Filed: Jan. 9, 2003

(65) Prior Publication Data

US 2003/0129066 A1 Jul. 10, 2003

(30) Foreign Application Priority Data

Jan. 10, 2002 (KR) ..... 10-2002-0001495

(51) Int. Cl.[7] ..... F04B 49/00
(52) U.S. Cl. ..... 417/306; 418/55.1; 417/310
(58) Field of Search ..... 417/306, 309, 417/310, 311, 410.3, 410.5; 137/513; 418/55.1, 57

(56) References Cited

U.S. PATENT DOCUMENTS 5,090,880 A * 2/1992 Mashimo ..... 417/310
5,156,539 A * 10/1992 Anderson et al. ..... 418/55.4
6,672,845 B1 * 1/2004 Kim et al. ..... 417/310

* cited by examiner

*Primary Examiner*—Justine R. Yu
*Assistant Examiner*—Han L Liu
(74) *Attorney, Agent, or Firm*—Birch, Stewart, Kolasch & Birch, LLP

(57) ABSTRACT

Disclosed is a vacuum preventing device for a scroll compressor comprising: a housing fixed to an upper surface of a fixed scroll to cover a compression hole and a suction hole and having a discharge hole at an upper surface thereof and a rotation member receiving space therein; and a rotation member fixed to a shaft of the receiving space so as to rotate by a pressure difference of gas introduced through the compression hole and the discharge hole and having a compression gas receiving groove for opening/closing the compression hole at one side thereof and a suction gas receiving groove for opening/closing the suction hole and the discharge hole at the other side thereof.

15 Claims, 8 Drawing Sheets

VACUUM PREVENTING DEVICE FOR SCROLL COMPRESSOR

BACKGROUND OF THE INVENTION

1. Field of the Invention

The present invention relates to a scroll compressor, and more particularly, to a vacuum preventing device for a scroll compressor in which gas in a discharge region flows backward to a suction region at the time of an abnormal driving such as a pump down or an expansion valve blocking, thereby preventing a vacuum of the compressor.

2. Description of the Background Art

Generally, a compressor is a device for converting mechanical energy into latent energy of a compression fluid, and is largely classified into a reciprocation compressor, a scroll compressor, a centrifugal compressor, and a vane compressor by compression methods.

The scroll compressor has a structure that gas is sucked, compressed, and discharged by using a rotation member like the centrifugal type and the vane type differently from the reciprocating type which uses a linear reciprocation of an piston.

FIG. 1 is a longitudinal sectional view showing an inner part of the conventional scroll compressor.

As shown, the scroll compressor comprises: a case 1 divided into a gas suction pipe SP and a gas discharge pipe DP; a main frame 2 and a sub frame (not shown) respectively installed at both sides of upper and lower portions of an inner circumference surface of the case 1; a driving motor 3 installed between the main frame 2 and the sub frame; a rotation shaft 4 engaged to a center portion of the driving motor 3 for transmitting a rotation force of the driving motor 3; an orbiting scroll 5 installed to have an eccentric rotation at an upper portion of the rotation shaft 4 and having a wrap 5*a* of an involute curve shape at the upper portion thereof; and a fixed scroll 6 engaged to the orbiting scroll 5, and having a wrap 6*a* of an involute curve shape so as to form a plurality of compression spaces P therein.

The case 1 is divided into a suction region S1 and a discharge region S2 by a high and low pressure separation plate 7, and a compression region S3 is formed at a position connected to the compression space P.

A gas inlet 6*b* and an outlet 6*c* are respectively formed at a lateral surface and a center portion of the fixed scroll 6, and a non-return valve 8 for preventing discharged gas from flowing backward is installed at an upper surface of the fixed scroll 6.

The main frame 2 and the sub frame are fixed to the inner circumference surface of the case 1 by a fixation means such as welding, and the fixed scroll 6 is also fixed to a bottom surface of the high and low pressure separation plate 7 by a fixation means such as a bolt.

Meantime, in case of a pump down and an expansion valve blocking, the suction region S1 of the compressor becomes a high vacuum state. At this time, components relevant to the compressor may be damaged and destroyed.

To prevent this, a vacuum preventing device 20 is provided in the conventional art.

FIG. 2 is a longitudinal sectional view showing an operation at the time of a normal driving in the vacuum preventing device of FIG. 1, FIG. 3 is a longitudinal sectional view showing an operation at the time of an abnormal driving in the vacuum preventing device of FIG. 1, and FIG. 4 is a sectional view taken along line A—A of FIG. 2.

Referring to FIGS. 2 and 3, the vacuum preventing device 20 includes a chamber 10 formed at one side of the fixed scroll 6, and a discharge hole 11 connected to the discharge region S2 at an upper surface of the chamber 10.

A compression hole 12 connected to the compression region S3 is formed at a bottom surface of the chamber 10, a plug 14 having a suction hole 13 is fixed to an opening portion of the chamber 10 by a fixation pin 15, and the suction hole 13 is connected to the discharge hole 11.

An open/close member 17 for selectively connecting the discharge hole 11 and the suction hole 13 is movably installed in the chamber 10.

A spring 16 for limiting a movement of the open/close member 17 and providing an elasticity force thereto is installed at the opening portion of the chamber 10.

Hereinafter, operations of the conventional scroll compressor will be explained.

First, when a power source is applied to the driving motor 3, the driving motor 3 rotates the rotation shaft 4, and the orbiting scroll 5 engaged to the rotation shaft 4 is rotated to an extent of its eccentric distance.

At this time, a plurality of compression spaces P formed between the wrap 5*a* of the orbiting scroll 5 and the wrap 6*a* of the fixed scroll 6 gradually move towards a center portion of the fixed scroll 6 as the orbiting scroll 5 continuously performs an orbiting movement, thereby having a decreased volume.

By the decreased volume of the compression spaces P, gas of the suction region S1 is sucked into the compression space P through the inlet 6*b*, and the sucked gas is discharged to the discharge region S2 through the outlet 6*c*.

When the compressor is normally driven, a pressure of the compression region is larger than an elasticity force of the spring 16, so that the open/close member 17 overcomes the elasticity force of the spring 16 and closes the discharge hole 11.

However, the compressor is abnormally driven, a pressure of the compression region is smaller than the elasticity force of the spring 16, so that the open/close member 17 is shoved by the elasticity force of the spring 16 and opens the discharge hole 11. At this time, the discharge hole 11 is connected to the suction hole 13.

As the discharge hole 11 and the suction hole 13 are connected to each other, gas of the discharge region S2 flows backward into the suction region S1 through the discharge hole 11 and the suction hole 13, thereby releasing a vacuum of the compressor.

As shown in FIG. 4, in the conventional scroll compressor, a minute clearance t is formed between an inner wall of the chamber 10 and an outer circumference surface of the open/close member 17 so as to induce a smooth slide movement of the open/close member 17.

Generally, the clearance is fabricated as the minimum size so that the open/close member 17 can slide the chamber 10, and fabricated as a minute size enough not to leak gas through the discharge hole 11 when the open/close member 17 closes the discharge hole 11.

When the clearance t becomes smaller, gas is closed more efficiently but an operation of the open/close member 17 is not smooth. On the contrary, when the clearance t becomes larger, gas leakage is increased and an operation of the open/close member 17 is smooth. Accordingly, considering the operation of the open/close member 17, the clearance t is designed and fabricated within a tolerance limit range.

However, in the conventional art, when the compressor is normally driven, the open/close member 17 receives a pressure downwardly by a gas pressure of the discharge region S2. At this time, a bottom surface of the open/close member 17 is adhered to an inner bottom surface of the chamber 10 and an upper surface of the open/close member 17 is more separated from an inner upper surface of the chamber 10. That is, the clearance t becomes large more than the tolerance limit range.

When the clearance t becomes large, a part of gas of the discharge region leaks to the suction region through the clearance, thereby degrading a compression efficiency of the compressor.

Also, in the conventional art, since high minuteness is required at the time of designing and fabricating the clearance, a high cost is required and a productivity is degraded.

SUMMARY OF THE INVENTION

Therefore, an object of the present invention is to provide a vacuum preventing device for a scroll compressor, in which a rotation member which selectively connects a discharge hole to a suction hole by being rotated by a pressure difference between the compression region and the discharge region is installed, so that a vacuum of the compressor can be efficiently prevented at the time of an abnormal driving and gas leakage of the discharge region is effectively prevented at the time of a normal driving, thereby enhancing a compression efficiency of the compressor.

To achieve these and other advantages and in accordance with the purpose of the present invention, as embodied and broadly described herein, there is provided a vacuum preventing device for a scroll compressor comprising: a housing fixed to an upper surface of a fixed scroll to cover a compression hole connected to a compression region of a compression space and a suction hole connected to a suction region, and having a discharge hole connected to the suction hole at an upper surface thereof and a rotation member receiving space therein; and a rotation member fixed to a shaft of the receiving space so as to rotate with a predetermined angle by a pressure difference of gas introduced through the compression hole and the discharge hole and having a compression gas receiving groove for opening/closing the compression hole at one side thereof and a suction gas receiving groove for opening/closing the suction hole and the discharge hole at the other side thereof.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
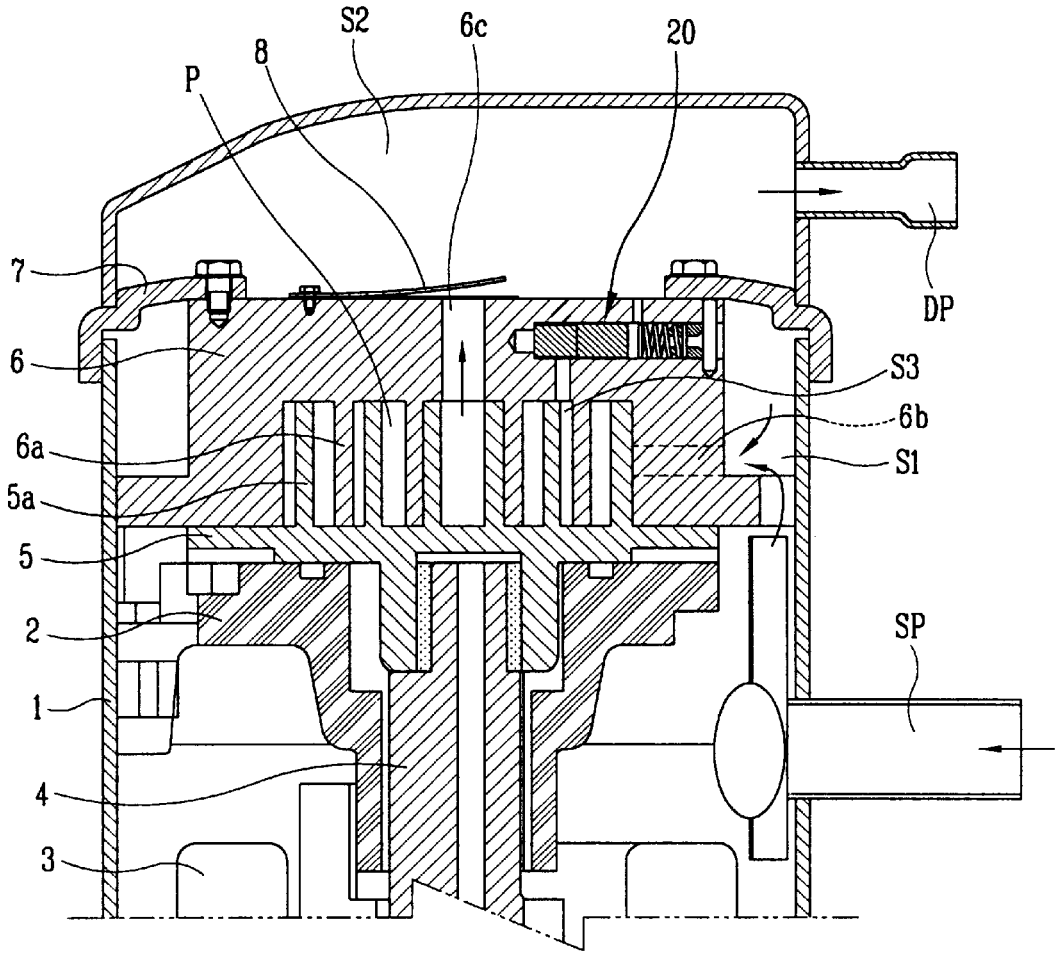
FIG. 1 CONVENTIONAL ART
FIG. 1 is a longitudinal sectional view showing an inner part of a conventional scroll compressor.
Figure 2:
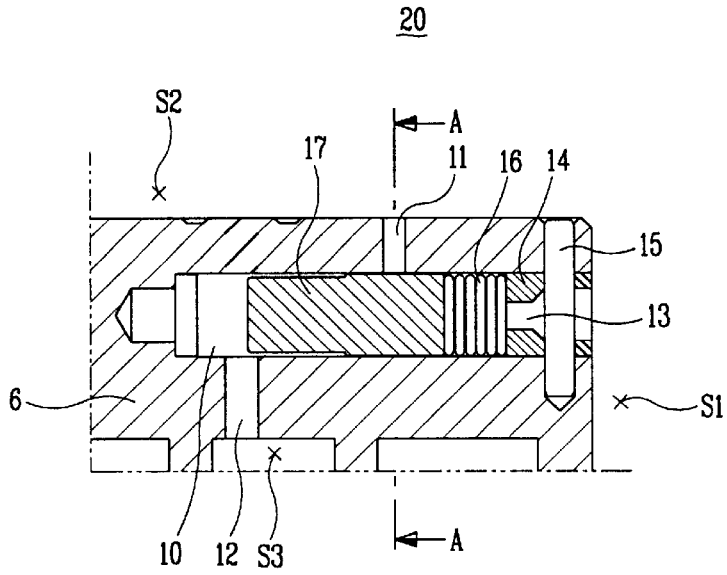
FIG. 2 CONVENTIONAL ART
FIG. 2 is a longitudinal sectional view showing an operation at the time of a normal driving in the vacuum preventing device of FIG. 1.
Figure 3:
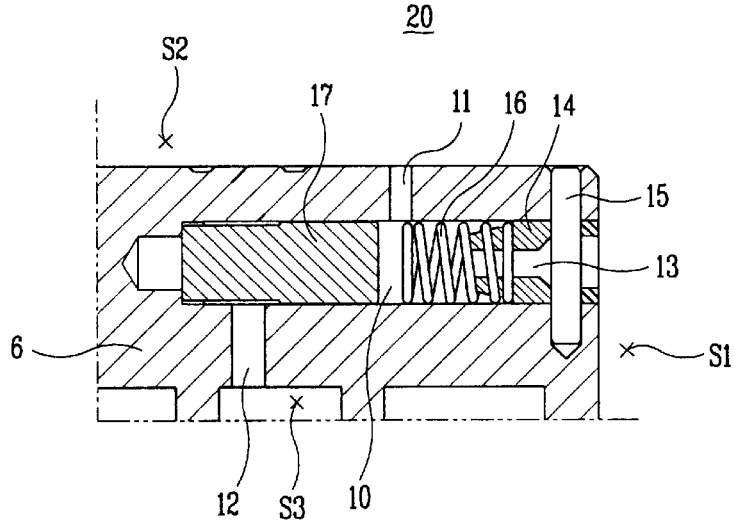
FIG. 3 CONVENTIONAL ART
FIG. 3 is a longitudinal sectional view showing an operation at the time of an abnormal driving in the vacuum preventing device of FIG. 1.
Figure 4:
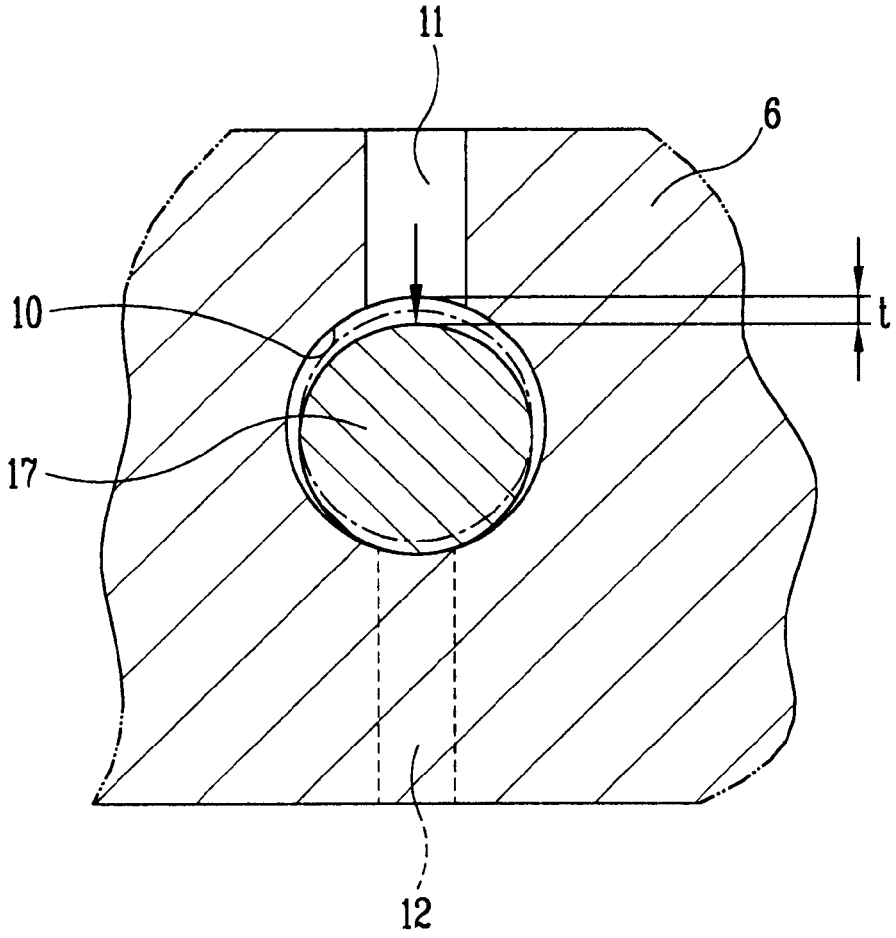
FIG. 4 CONVENTIONAL ART
FIG. 4 is a sectional view taken along line A—A of FIG. 2.
Figure 5:
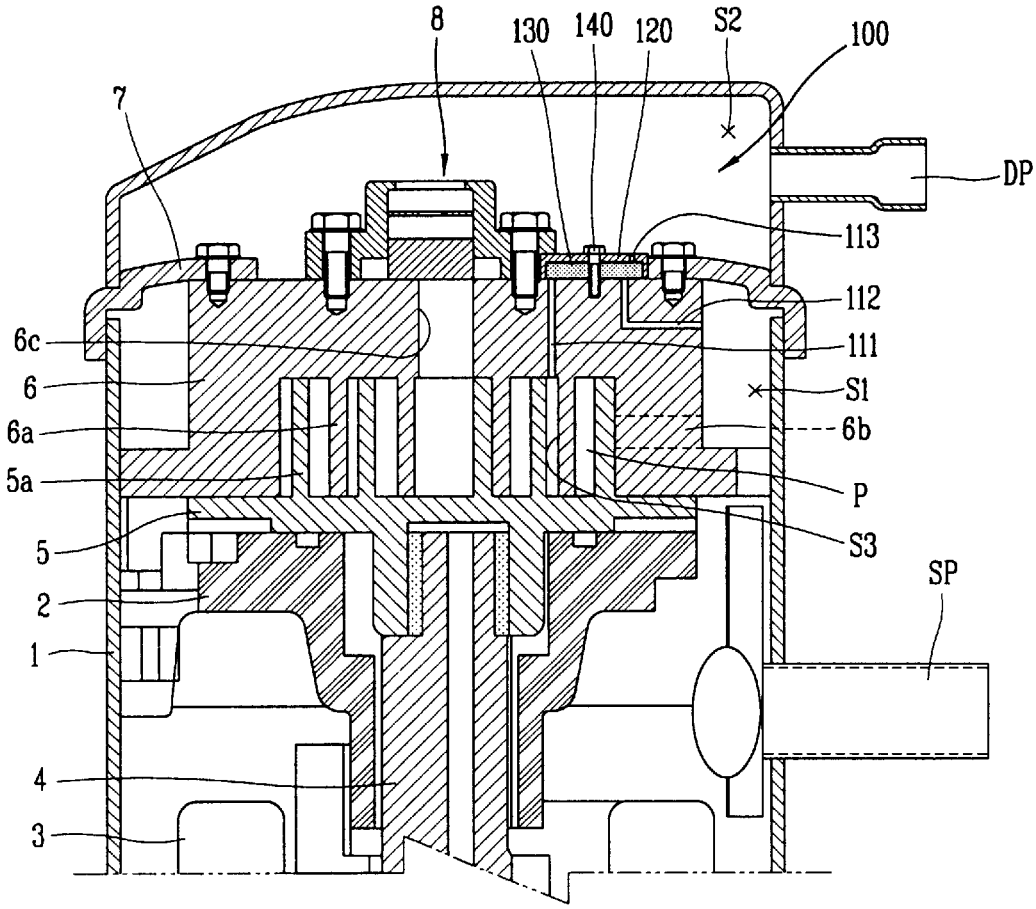
FIG. 5 is a longitudinal sectional view showing a scroll compressor according to the present invention.
Figure 6:
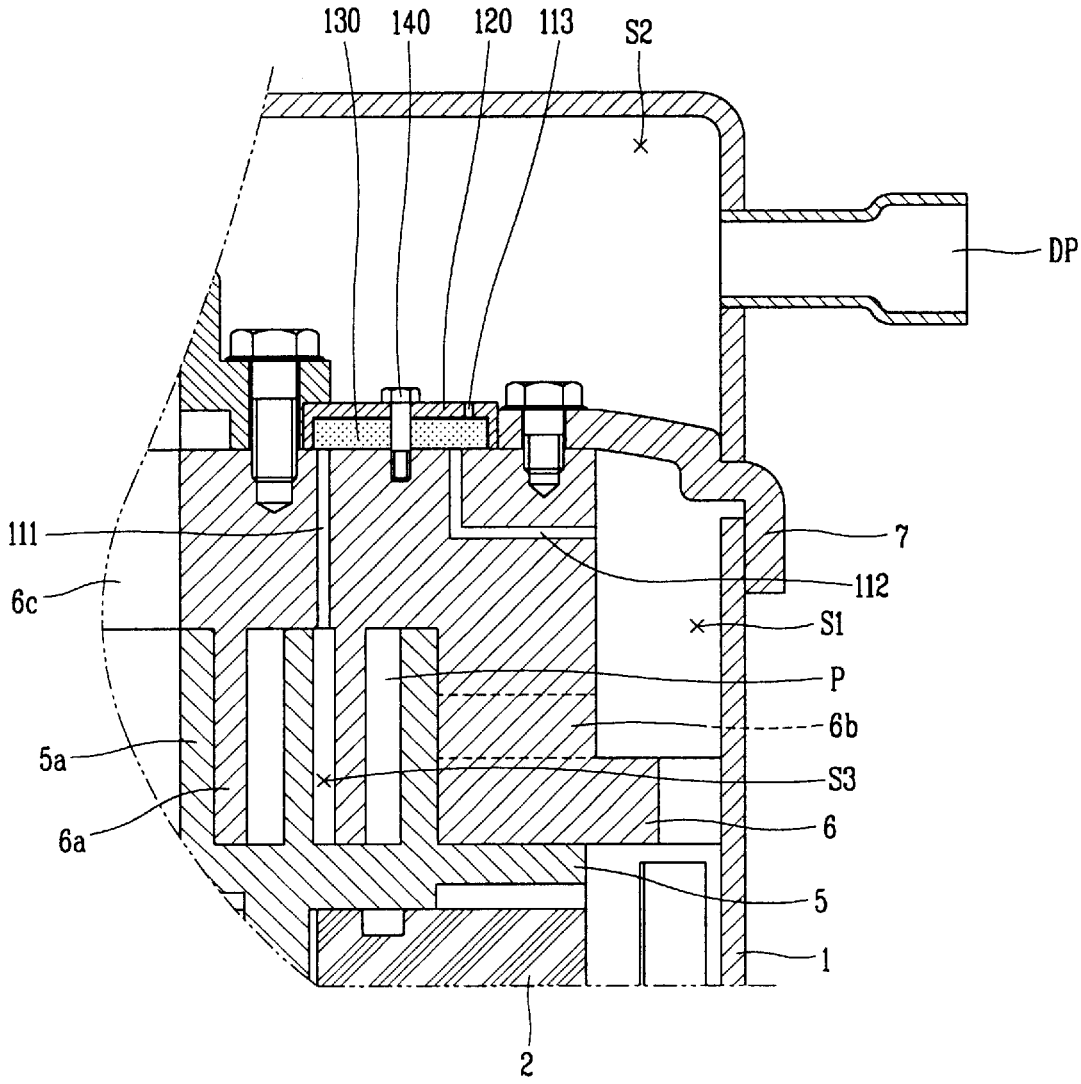
FIG. 6 is a longitudinal sectional view showing a vacuum preventing device for a scroll compressor according to the present invention.
Figure 7:
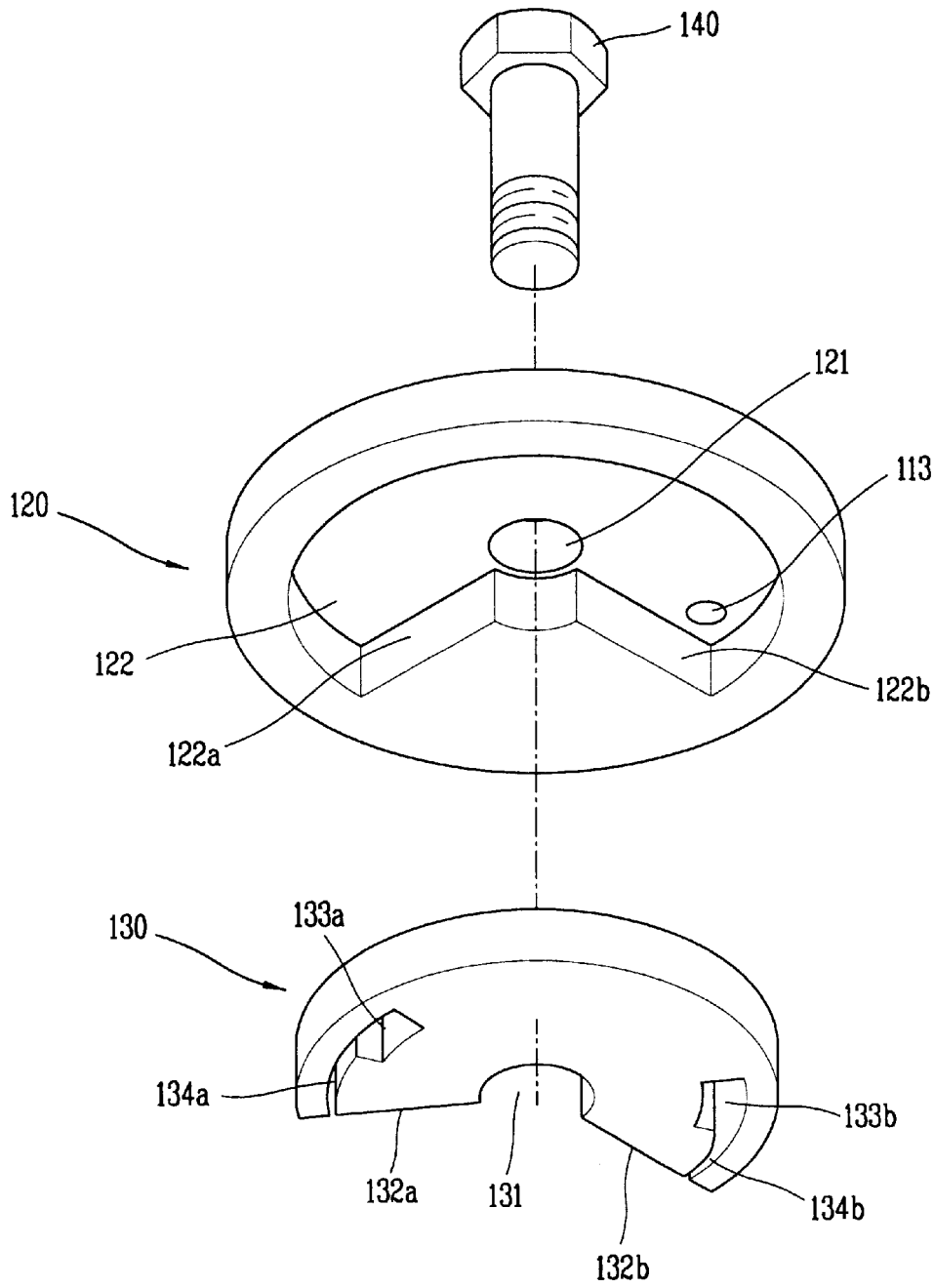
FIG. 7 is a disassembled perspective view showing the vacuum preventing device for a scroll compressor according to the present invention.
Figure 8:
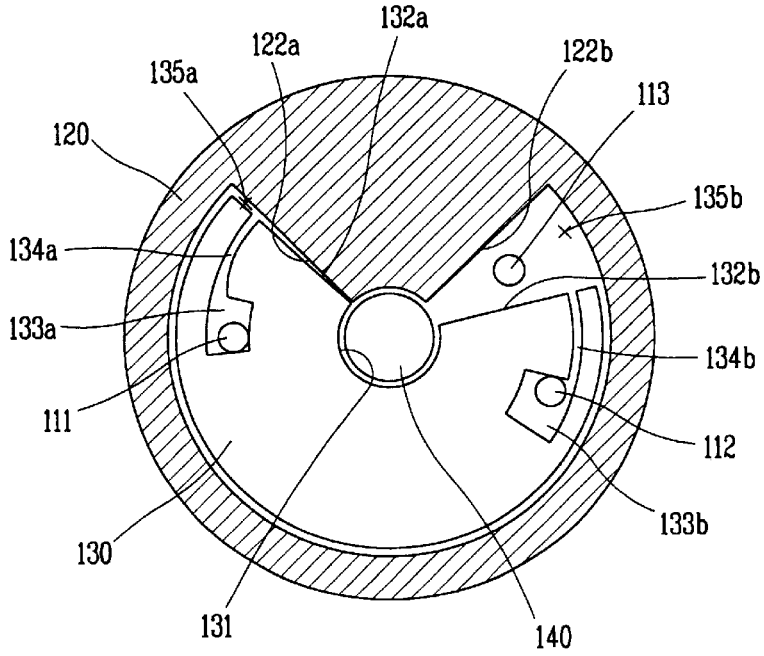
FIG. 8 is a cross-sectional view showing an operation at the time of an initial driving and an abnormal driving of FIG. 6.
Figure 9:
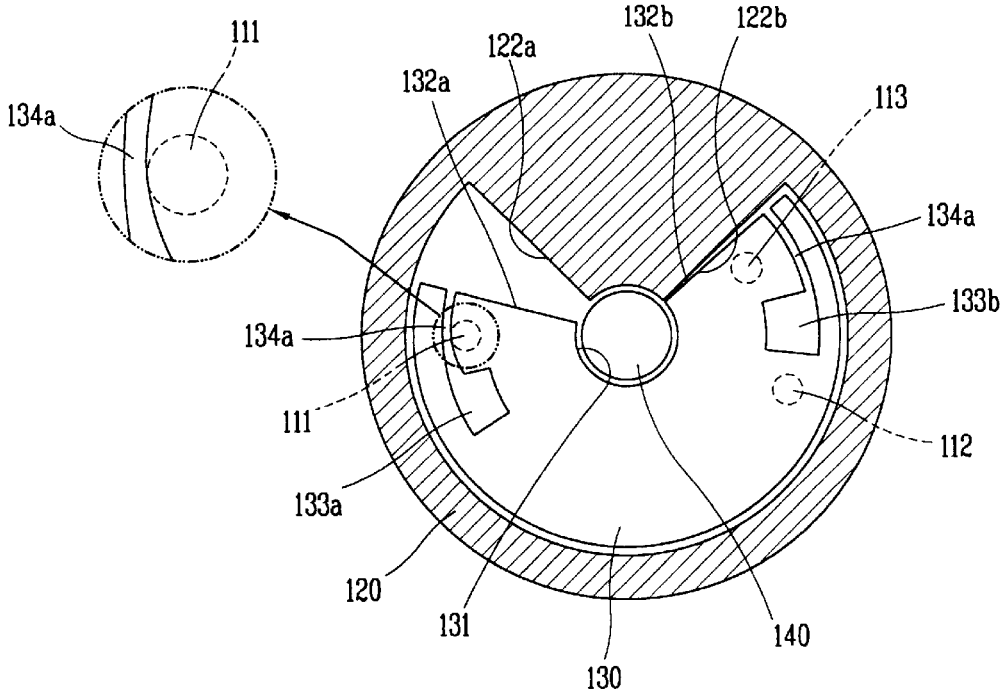
FIG. 9 is a cross-sectional view showing an operation at the time of a normal driving of FIG. 6.
Figure 10:
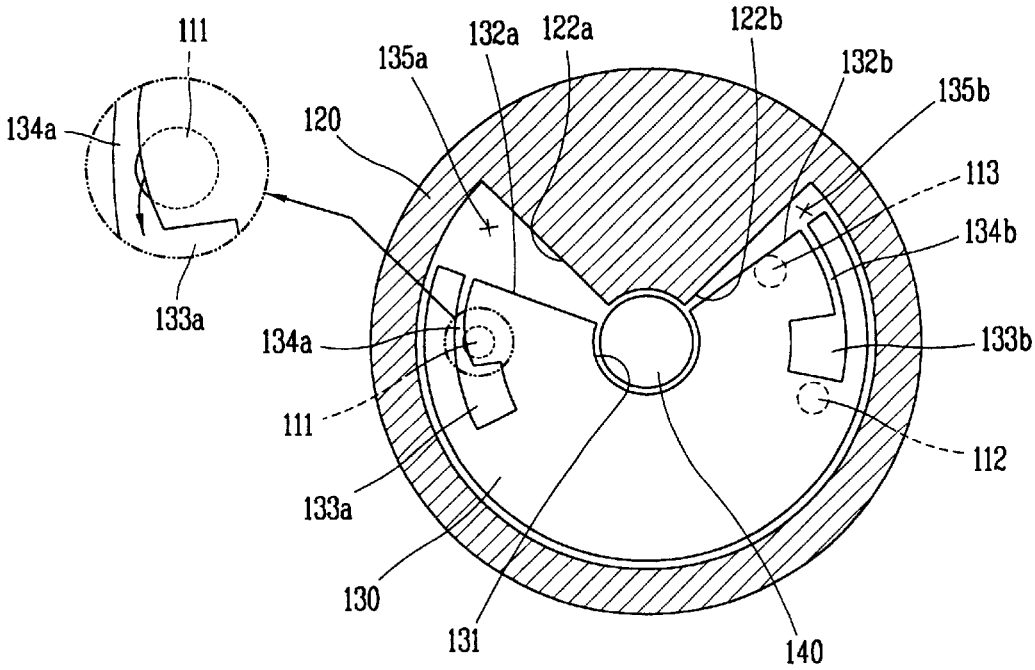
FIG. 10 is a cross-sectional view showing an operation at the time of gas leakage of FIG. 6.

FIG. 5 is a longitudinal sectional view showing a scroll compressor according to the present invention, FIG. 6 is a longitudinal sectional view showing a vacuum preventing device for a scroll compressor according to the present invention, FIG. 7 is a disassembled perspective view showing the vacuum preventing device for a scroll compressor according to the present invention, FIG. 8 is a cross-sectional view showing an operation at the time of an initial driving and an abnormal driving of FIG. 6, FIG. 9 is a cross-sectional view showing an operation at the time of a normal driving of FIG. 6, and FIG. 10 is a cross-sectional view showing an operation at the time of gas leakage of FIG. 6.

As shown, the scroll compressor according to the present invention comprises: a case 1 divided into a suction region S1 for sucking gas and a discharge region S2 for discharging the sucked gas; a fixed scroll 6 fixed to an inner portion of the case 1; an orbiting scroll 5 having a compression space P connected to a compression region S3 therein by being engaged to the fixed scroll 6 and eccentrically engaged to the rotation shaft 4 of a driving motor 3 in the case 1 so as to suck, compress, and discharge gas; and a vacuum preventing device 100 for preventing a vacuum of the compressor by flowing gas in the discharge region S2 backward into the suction region S1 at the time of an abnormal driving.

That is, the case 1 is divided into the suction region S1 and the discharge region S2 by a high and low pressure separation plate 7, and the case 1 of the suction region S1 is provided with a gas suction pipe SP and the case 1 of the discharge region S2 is provided with a gas discharge pipe DP. The orbiting scroll 5 eccentrically installed at an upper end portion of the rotation shaft 4 has a wrap 5*a* of an involute curve shape at an upper portion thereof, and the fixed scroll 6 engaged to the orbiting scroll 5 also has a wrap 6*a* of an involute curve shape at a lower portion thereof.

A gas inlet 6*b* and an outlet 6*c* are respectively formed at a lateral surface and a center portion of the fixed scroll 6, and a non-return valve 8 for preventing discharged gas from flowing backward is installed at an upper surface of the fixed scroll 6.

In the meantime, as aforementioned, in case of the pump down and the expansion valve blocking, the suction region S1 of the compressor becomes a high vacuum state. At this time, components relevant to the compressor may be damaged and destroyed.

To prevent this, in the present invention, the vacuum preventing device 100 composed of a rotation member having a plate shape and a housing for receiving the rotation member is provided.

A compression hole 111 is formed at one side of the upper surface of the fixed scroll 6 to be connected to a compression region S3 of the compression space P, and a suction hole 112 is formed at the other side of the upper surface of the fixed scroll 6 to be connected to the suction region S1.

A housing is positioned at the upper surface of the fixed scroll 6 so as to cover the compression hole 111 and the suction hole 112. A discharge hole 113 connected to the suction hole 112 is formed at an out wall of the upper surface of the housing 120, a through hole 121 is formed at a center of the upper surface of the housing 120, and a rotation member receiving groove 122 is formed at an inner portion of the housing 120.

A rotation member 130 is inserted into the rotation member receiving groove 122, and the rotation member 130 is provided with a hinge groove 131 at the center thereof.

A shaft 140 of a bolt shape is inserted into the through hole 121 of the housing 120 and the hinge groove 131 of the rotation member 130, and the shaft 140 is fixed to the upper surface of the fixed scroll 6.

The housing 120 is fixed to the upper surface of the fixed scroll 6 by the shaft 140, and the rotation member 130 is rotated with a predetermined angle in the rotation member receiving groove 122.

The rotation member receiving groove 122 is formed as a fan shape having a central angle of 250~280° on the basis of the shaft 140, and stop projection portions 122*a* and 122*b* for limiting a rotation angle of the rotation member 130 are formed at both sides of the rotation member receiving groove 122.

The rotation member 130 is formed as a fan shape having a central angle of 200~240° on the basis of the shaft 140, and stop faces 132*a* and 132*b* are respectively formed at both sides of the rotation member 130.

The rotation member 130 is rotated with a predetermined angle clockwise or counterclockwise by a pressure difference of gas introduced through the compression hole 111 and the discharge hole 113.

A compression gas receiving groove 133*a* for opening/closing the compression hole 111 is formed at one side of the rotation member 130, and a discharge gas receiving groove 133*b* for opening/closing the suction hole 112 and the discharge hole 113 is formed at the other side thereof.

A compression gas flow passage 134*a* is formed at the compression gas receiving groove 133*a* up to the stop face 132*a*, and a discharge gas flow passage 134*b* is also formed at the discharge gas receiving groove 133*b* up to the stop face 132*b*.

As shown in FIG. 8, a compression gas storage portion 135*a* for collecting gas of the compression region S2 is formed between the stop projection portion 122*a* of the housing 120 and the stop face 132*a* of the rotation member 130, and a discharge gas storage portion 135*b* for collecting gas of the discharge region S3 is formed between the stop projection portion 122*b* of the housing 120 and the stop face 132*b* of the rotation member 130.

At the time of a normal driving, the compression gas storage portion 135*a* is expanded by a rotation of the rotation member 130, the discharge gas storage portion 135*b* is contracted, and the compression hole 111, the suction hole 112, and the discharge hole 113 are closed by the rotation member 130.

At the time of an abnormal driving, the compression gas storage portion 135*a* is contracted by a rotation of the rotation member 130, the discharge gas storage portion 135*b* is expanded, the compression hole 111 is positioned at the compression gas receiving groove 133*a*, the suction hole 112 is positioned at the discharge gas receiving groove 133*b*, and the discharge hole 113 is positioned at the discharge gas storage portion 135*b*.

At the time of a normal driving, a width of the compression gas flow passage 134*a* is larger at the compression gas receiving groove 133*a* than at the stop face 132*a* so as to prevent a backward rotation of the rotation member 130 due to gas leakage in the discharge region.

More specifically, the compression gas flow passage 134*a* has a constant width at the stop face 132*a* but has a width larger than that at the stop face 132*a* at the compression gas receiving groove 133*b*.

In case that the rotation member 130 is rotated backward due to gas leakage through the discharge hole 113 at the time of a normal driving, a part of gas of the compression region S3 is supplied through the compression gas flow passage 134*a*, thereby preventing the rotation member 130 from being rotated backward.

An interval between the rotation member 130 and the housing 120 and an interval between the rotation member 130 and the shaft 140 are sealed. At this time, the seal has to be performed in a range that the rotation member 130 is smoothly operated.

At the time of an initial driving, the compression hole 111 is positioned at the compression gas receiving groove 133*a*, the suction hole 112 is positioned at the discharge gas receiving groove 133*b*, and the discharge hole 113 is positioned at the discharge gas storage portion 135*b*.

Hereinafter, the operation and effects of the vacuum preventing device for a scroll compressor according to the present invention will be explained.

As aforementioned, in accordance with that the orbiting scroll 5 orbits by the driving motor 3, gas in the suction region S1 is sucked, compressed in the compression space P, and discharged to the discharge region S2.

Referring to FIGS. 8 and 9, when the compressor is normally driven, gas of the compression region S3 is introduced into the compression gas receiving groove 133*a* through the compression hole 111, and the introduced gas is again introduced into the compression gas storage portion 135*a* along the compression gas flow passage 134*a*.

The rotation member 130 is rotated on the basis of the shaft 140 by a pressure of the gas stored in the compression gas storage portion 135*a*, in which the compression gas storage portion 135*a* is expanded and the discharge gas storage portion 135*b* is contracted.

As the rotation member 130 is rotated, the stop face 132*b* of the rotation member 130 is caught in the stop projection portion 122*b* of the housing 120, thereby limiting a rotation of the rotation member 130.

The compression hole 111 is closed by one side of the rotation member 130, and the discharge hole 113 and the suction hole 112 are closed by the other side thereof.

When the compressor is abnormally driven, pressures of the compression region S3 and the suction region S1 become low and a pressure of the discharge region S2 becomes relatively high.

At this time, gas in the discharge region S2 is introduced into the discharge gas storage portion 135*b* through the discharge hole 113, and the gas is introduced to the discharge gas receiving groove 133*b* along the discharge gas flow passage 134*b*.

In accordance with that a pressure of the gas introduced into the discharge gas storage portion 135*b* is gradually increases, the rotation member 130 is rotated on the basis of the shaft 140. At this time, the discharge gas storage portion 135*b* is expanded and the compression gas storage portion 135*b* is contracted.

As the rotation member 130 is rotated, the stop face 132*a* of the rotation member 130 is caught in the stop projection portion 122*a* of the housing 120, thereby limiting a rotation of the rotation member 130.

At this time, the compression hole 111 is positioned at the compression gas receiving groove 133*a*, the suction hole 112 is positioned at the discharge gas receiving groove 133*b*, and the discharge hole 113 is positioned at the discharge gas storage portion 135*b*.

At this time, as the discharge hole 113 and the suction hole 112 are connected through the discharge gas flow passage 134*b*, gas introduced through the discharge hole 113 moves along the discharge gas flow passage 134*b* and flows backward through the suction hole 112.

In accordance with that gas of the discharge region S2 flows backward into the suction region S1, a high vacuum of the compressor is prevented.

Hereinafter, operations of the device will be explained with reference to FIGS. 8 to 10.

As shown in FIG. 8, at the time of an initial driving, a pressure of the discharge region S2 is larger than that of the compression region S3 like a case of an abnormal driving, so that the discharge gas storage portion 135*b* maintains a size larger than that of the compression gas storage portion 135*a*, and the compression hole 111, the discharge hole 113, and the suction hole 112 are all in an opened state.

When the driving is started, a pressure of the compression region S3 becomes large and gas is introduced into the compression gas receiving groove 133*a* through the compression hole 111.

The gas introduced into the compression gas receiving groove 133*a* is again introduced into the compression gas storage portion 135*a* along the compression gas flow passage 134*a*.

By a pressure of the gas stored in the compression gas storage portion 135*a*, the rotation member 130 is rotated on the basis of the shaft 140. At this time, the compression gas storage portion 135*a* is expanded and the discharge gas storage portion 135*b* is contracted.

When the rotation member 130 is rotated to a degree, as shown in FIG. 9, the stop face 132*b* of the rotation member 130 is caught in the stop projection portion 122*b* of the housing 120, thereby limiting a rotation of the rotation member 130.

The compression hole 111 is closed by one side of the rotation member 130, and the discharge hole 113 and the suction hole 112 are closed by the other side thereof.

At the time of a normal driving, a pressure of the discharge region S2 becomes gradually larger than that of the compression region S3, so that a part of gas of the discharge region S2 is introduced into the discharge gas storage portion 135*b* through the discharge hole 113 and the rotation member 130 is rotated a little clockwise on the basis of the shaft 140 as a pressure of the discharge gas storage portion 135*b* is increased. At this time, the gas introduced through the discharge hole 113 may leak out through the suction hole 112.

To solve said problem, as shown in FIG. 10, a structure for preventing the gas leakage from the discharge hole 113 is provided.

That is, if the rotation member 130 is rotated and approaches to the compression gas flow passage 134*a* adjacent to the compression gas receiving groove 133*a*, the compression hole 111 is opened to a degree and gas is introduced into the compression gas storage portion 135*a* through the compression hole 111, thereby increasing its pressure.

As the pressure of the compression gas storage portion 135*a* is increased, the rotation member 130 is rotated clockwise on the basis of the shaft 140 and returns to an initial position.

As aforementioned, in the present invention, the rotation member which selectively connects the discharge hole to the suction hole by being rotated by a pressure difference between the compression region and the discharge region is installed, so that a vacuum of the compressor can be efficiently prevented at the time of an abnormal driving and gas leakage in the discharge region is effectively prevented at the time of a normal driving, thereby enhancing a compression efficiency of the compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum preventing device for a scroll compressor comprising:

a housing fixed to an upper surface of a fixed scroll to cover a compression hole connected to a compression region of a compression space and a suction hole connected to a suction region, and having a discharge hole connected to the suction hole at an upper surface thereof and a rotation member receiving groove therein;

and a rotation member fixed to a shaft of the rotation member receiving groove so as to rotate with a predetermined angle by a pressure difference of gas introduced through the compression hole and the discharge hole.

2. The device of claim 1, wherein the rotation member includes a compression gas receiving groove for opening/closing the compression hole at one side thereof and a discharge gas receiving groove for opening/closing the suction hole and the discharge hole at the other side thereof.

3. The device of claim 1, wherein the rotation member receiving groove is formed as a fan shape having a central angle of 250~280° on the basis of the shaft.

4. The device of claim 1, wherein the rotation member is formed as a fan shape having a central angle of 200~240° on the basis of the shaft.

5. The device of claim 1, wherein stop faces are formed at both sides of the rotation member, and stop projection portions for limiting a rotation angle of the rotation member are formed at both sides of the rotation member receiving groove with a predetermined interval with the stop faces.

6. The device of claim 5, wherein a compression gas storage portion for collecting gas of a compression region and a discharge gas storage portion for collecting gas of a discharge region are formed between the stop projection portions of the housing and the stop faces of the rotation member.

7. The device of claim 1, wherein at the time of a normal driving, the compression hole, the suction hole, and the discharge hole are closed by the rotation member.

8. The device of claim 1, wherein at the time of an abnormal driving, the compression hole is positioned at the discharge gas receiving groove, the suction hole is positioned at the other discharge gas receiving groove, and the discharge hole is positioned at the discharge gas storage portion.

9. The device of claim 1, wherein a compression gas flow passage is formed at the compression gas receiving groove up to the stop face, and a discharge gas flow passage is formed at the discharge gas receiving groove up to the stop face.

10. The device of claim 9, wherein at the time of a normal driving, a width of the compression gas flow passage is larger at the compression gas receiving groove than at the stop face so as to prevent a backward rotation of the rotation member.

11. The device of claim 9, wherein in case that the rotation member is rotated backward due to gas leakage through the discharge hole, a part of gas of the compression region is supplied through the compression gas flow passage, thereby preventing the rotation member from being rotated backward.

12. The device of claim 1, wherein an interval between the rotation member and the housing and an interval between the rotation member and the shaft are sealed.

13. The device of claim 1, wherein at the time of an initial driving, the compression hole is positioned at the compression gas receiving groove, the suction hole is positioned at the discharge gas receiving groove, and the discharge hole is positioned at the discharge gas storage portion.

14. The device of claim 1, wherein a through hole is formed at a center portion of the housing and a hinge groove is formed at a center portion of the rotation member so that the shaft can be inserted thereto.

15. The device of claim 1, wherein the shaft is fixed to an upper surface of the fixed scroll.

* * * * *